US008833890B2

(12) United States Patent
Endo et al.

(10) Patent No.: US 8,833,890 B2
(45) Date of Patent: Sep. 16, 2014

(54) LIQUID EJECTING APPARATUS

(71) Applicant: Seiko Epson Corporation, Tokyo (JP)

(72) Inventors: Hironori Endo, Okaya (JP); Toshihisa Saruta, Matsumoto (JP); Toru Matsuyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/051,334

(22) Filed: Oct. 10, 2013

(65) Prior Publication Data

US 2014/0098149 A1 Apr. 10, 2014

(30) Foreign Application Priority Data

Oct. 10, 2012 (JP) ..... 2012-224847

(51) Int. Cl.
*B41J 29/38* (2006.01)

(52) U.S. Cl.
USPC ..... 347/10; 347/5; 347/11

(58) Field of Classification Search
USPC ..... 347/5, 9, 10, 11
See application file for complete search history.

(56) References Cited

U.S. PATENT DOCUMENTS

| | | | | |
|---|---|---|---|---|
| 8,287,069 | B2 | 10/2012 | Tabata et al. | |
| 2009/0066739 | A1 * | 3/2009 | Tabata et al. | 347/10 |
| 2009/0303271 | A1 * | 12/2009 | Tabata et al. | 347/10 |

FOREIGN PATENT DOCUMENTS

| | | | |
|---|---|---|---|
| JP | 2010-114711 | A | 5/2010 |
| JP | 2011-207234 | A | 10/2011 |

* cited by examiner

*Primary Examiner* — Lam S Nguyen
(74) *Attorney, Agent, or Firm* — Kilpatrick Townsend & Stockton LLP

(57) ABSTRACT

A liquid ejecting apparatus includes a reference drive signal generation section that generates an analog reference drive signal, a signal modulation section that modulates the reference drive signal to generate a digital modulation reference drive signal, a signal amplification section that amplifies the modulation reference drive signal to generate a modulation drive signal, a signal conversion section that converts the modulation drive signal to an analog drive signal, and a liquid ejecting section that ejects a liquid in response to the drive signal. A sum of a resistance value of a reference drive signal transfer line and a resistance value of a drive signal transfer line is smaller than a sum of a resistance value of a modulation reference drive signal transfer line and a resistance value of a modulation drive signal transfer line.

12 Claims, 6 Drawing Sheets

LIQUID EJECTING APPARATUS

BACKGROUND

1. Technical Field

The present invention relates to a liquid ejecting apparatus.

2. Related Art

An ink jet printer is widely used, which ejects ink on a print medium from a plurality of nozzles provided in a print head so as to record text and images. In such an ink jet printer, a predetermined amount of ink is ejected from the nozzles at a predetermined timing by actuators, each of which is provided in a location corresponding to each nozzle of the print head, being driven in response to a drive signal.

For example, the drive signal is generated by the following procedure. A digital modulation reference drive signal is generated by pulse-modulating an analog reference drive signal using a Pulse Width Modulation (PWM) method or a Pulse Density Modulation (PDM) method. Then, the modulation reference drive signal is amplified to generate a modulation drive signal, and the modulation drive signal is converted into a drive signal, which is an analog signal, by smoothing (for example, see JP-A-2010-114711).

In the ink jet printer, there is a problem that ink is ejected in response to the drive signal, so that noise components of the drive signal may reduce an eject stability of the ink.

In addition, such a problem is not limited to the ink jet printer, but may occur similarly in a liquid ejecting apparatus which ejects a liquid in response to the drive signal.

SUMMARY

The invention can be realized in the following forms.

1. According to a first aspect of the invention, there is provided a liquid ejecting apparatus. The liquid ejecting apparatus includes: a reference drive signal generation section that generates an analog reference drive signal; a signal modulation section that modulates the reference drive signal to generate a digital modulation reference drive signal; a signal amplification section that amplifies the modulation reference drive signal to generate a modulation drive signal; a signal conversion section that converts the modulation drive signal to an analog drive signal; a liquid ejecting section that ejects a liquid in response to the drive signal; a reference drive signal transfer line that transfers the reference drive signal from the reference drive signal generation section to the signal modulation section; a modulation reference drive signal transfer line that transfers the modulation reference drive signal from the signal modulation section to the signal amplification section; a modulation drive signal transfer line that transfers the modulation drive signal from the signal amplification section to the signal conversion section; and a drive signal transfer line that transfers the drive signal from the signal conversion section to the liquid ejecting section. A sum of a resistance value of the reference drive signal transfer line and a resistance value of the drive signal transfer line is smaller than a sum of a resistance value of the modulation reference drive signal transfer line and a resistance value of the modulation drive signal transfer line. In this case, since the sum of resistance values of the signal lines for transferring analog signals is smaller than the sum of resistance values of the signal lines for transferring digital signals, it is possible to suppress the influence of noise on the signal, thereby improving the ejection stability of the ink by suppressing noise components in the drive signal.

2. It is preferable that the drive signal transfer line may have a smallest resistance value among the signal transfer lines. In this case, it is possible to suppress as much noise in the drive signal transfer line which has a great influence on the ejection stability degradation of the ink because it is closest to the liquid ejecting section, and to effectively improve the ejection stability of the liquid, while suppressing the distortion of the drive signal.

3. It is preferable that the reference drive signal transfer line have a smallest resistance value among the signal transfer lines. In this case, it is possible to suppress as much noise superimposed on the signal before amplification, and to effectively improve the ejection stability of the ink.

4. It is preferable that a resistance value of the modulation reference drive signal transfer line be smaller than a resistance value of the modulation drive signal transfer line. In this case, it is possible to suppress as much noise superimposed on the signal before amplification, and to effectively improve the ejection stability of the ink.

5. It is preferable that a resistance value of the modulation reference drive signal transfer line be greater than a resistance value of the modulation drive signal transfer line. In this case, it is possible to suppress an attenuation of the signal after amplification, and thus to suppress a decrease in ejection stability of the ink.

6. It is preferable that a resistance value of the drive signal transfer line be smaller than a resistance value of the modulation drive signal transfer line. In this case, since the resistance value of the drive signal transfer line for transferring a digital signal, on which noise components are likely to remain is smaller than the resistance value of the modulation drive signal transfer line for transferring an analog signal, it is possible to suppress as much residual noise, and to effectively improve the ejection stability of the ink.

7. According to a second aspect of the invention, there is provided a liquid ejecting apparatus. The liquid ejecting apparatus includes: a reference drive signal generation section that generates an analog reference drive signal; a signal modulation section that modulates the reference drive signal to generate a digital modulation reference drive signal; a signal amplification section that amplifies the modulation reference drive signal to generate a modulation drive signal; a signal conversion section that converts the modulation drive signal to an analog drive signal; a liquid ejecting section that ejects a liquid in response to the drive signal; a reference drive signal transfer line that transfers the reference drive signal from the reference drive signal generation section to the signal modulation section; a modulation reference drive signal transfer line that transfers the modulation reference drive signal from the signal modulation section to the signal amplification section; a modulation drive signal transfer line that transfers the modulation drive signal from the signal amplification section to the signal conversion section; and a drive signal transfer line that transfers the drive signal from the signal conversion section to the liquid ejecting section. A sum of a length of the reference drive signal transfer line and a length of the drive signal transfer line may be smaller than a sum of a length of the modulation reference drive signal transfer line and a length of the modulation drive signal transfer line. In this case, if it is assumed that the materials and the diameters of respective signal transfer lines are substantially identical to each other, the sum of resistance values of the signal lines for transferring analog signals is smaller than the sum of resistance values of the signal lines for transferring digital signals, so that it is possible to suppress the influence of noise on the signal, thereby improving the ejection stability of the ink by suppressing noise components in the drive signal.

8. It is preferable that the drive signal transfer line may have a shortest length among the signal transfer lines. In this case, if it is assumed that the materials and the diameters of respective signal transfer lines are substantially identical to each other, the drive signal transfer line has the smallest resistance value among the signal transfer lines, so that it is possible to suppress as much noise in the drive signal transfer line which has a great influence on the ejection stability degradation of the ink because it is closest to the liquid ejecting section, and to effectively improve the ejection stability of the liquid, while suppressing the distortion of the drive signal.

9. It is preferable that the reference drive signal transfer line have a shortest length among the signal transfer lines. In this case, if it is assumed that the materials and the diameters of respective signal transfer lines are substantially identical to each other, the reference drive signal transfer line has the smallest resistance value among the signal transfer lines, so that it is possible to suppress as much noise superimposed on the signal before amplification, and to effectively improve the ejection stability of the ink.

10. It is preferable that a length of the modulation reference drive signal transfer line be shorter than a length of the modulation drive signal transfer line. In this case, if it is assumed that the materials and the diameters of respective signal transfer lines are substantially identical to each other, the resistance value of the modulation reference drive signal transfer line is smaller than the resistance value of the modulation drive signal transfer line, so that it is possible to suppress as much noise superimposed on the signal before amplification, and to effectively improve the ejection stability of the ink.

11. It is preferable that a length of the modulation reference drive signal transfer line be longer than a length of the modulation drive signal transfer line. In this case, if it is assumed that the materials and the diameters of respective signal transfer lines are substantially identical to each other, the resistance value of the modulation reference drive signal transfer line is greater than the resistance value of the modulation drive signal transfer line, so that it is possible to suppress an attenuation of the signal after amplification, and thus to suppress a decrease in ejection stability of the ink.

12. It is preferable that a length of the drive signal transfer line be shorter than a length of the modulation drive signal transfer line. In this case, if it is assumed that the materials and the diameters of respective signal transfer lines are substantially identical to each other, the resistance value of the drive signal transfer line for transferring a digital signal, on which noise components are likely to remain is smaller than the resistance value of the modulation drive signal transfer line for transferring an analog signal, so that it is possible to suppress as much residual noise as, and to effectively improve the ejection stability of the ink.

Further, the invention can be realized in various forms, for example, in forms of a liquid ejecting apparatus and a driving device for a liquid ejecting apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. Exemplary Embodiment

Figure 1:
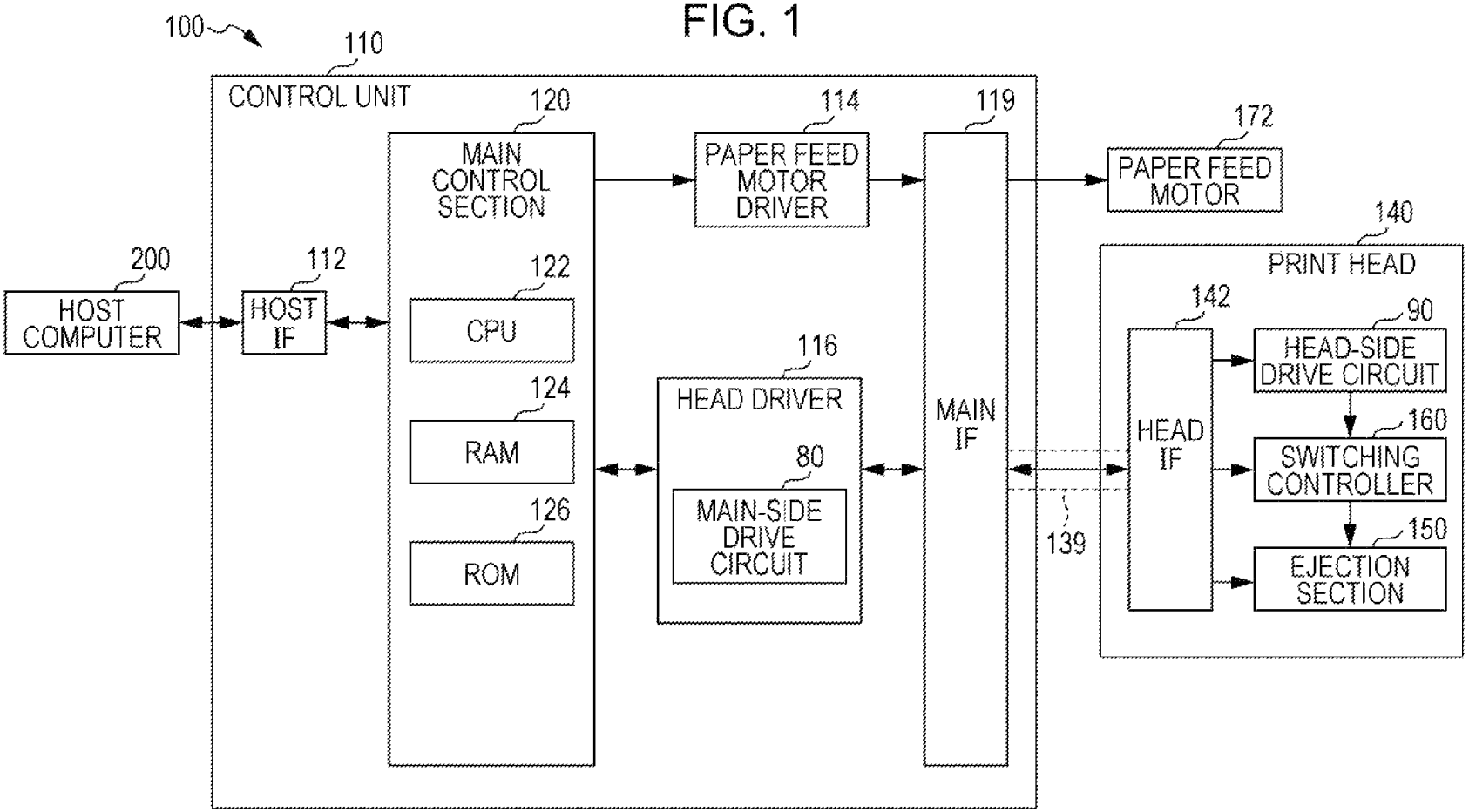
FIG. 1 is an explanatory diagram illustrating each schematic configuration focusing on a control unit and a print head of a printing apparatus.

FIG. 1 is an explanatory diagram illustrating a schematic configuration of a printing apparatus 100 in an exemplary embodiment of the invention. The printing apparatus 100 of the present exemplary embodiment is a printer which ejects liquid ink to form an ink dot group on a print medium, and thus prints images (including characters, graphics, and the like) in response to image data supplied from a host computer 200.

The printing apparatus 100 includes a print head 140, and a control unit 110 connected to the print head 140 through a flexible flat cable 139. The control unit 110 includes a host interface (IF) 112 for inputting image data and the like from a host computer 200, a main control section 120 that performs a predetermined arithmetic processing of printing images on the basis of image data that is input from the host interface 112, a paper feed motor driver 114 which drives and controls a paper feed motor 172 for the transport of the print media, a head driver 116 which drives and controls the print head 140, and a main interface (IF) 119 which connects respective drivers 114, 116 with the paper feed motor 172 and the print head 140. The head driver 116 includes a main side drive circuit 80.

The main control section 120 includes a CPU 122 for executing various types of arithmetic processing, a RAM 124 for temporarily storing and developing programs and data, and a ROM 126 for storing programs executed by the CPU 122. The CPU 122 reads the programs, which is stored in the ROM 126, on the RAM 124 and executes the programs so as to realize various functions of the main control section 120. In addition, the main control section 120 may include electrical circuits, and thus a part of functions of the main control section 120 may be realized by the operation of the electrical circuits included in the main control section 120 on the basis of a configuration of the circuit.

If the main control section 120 acquires image data from the host computer 200 through the host interface 112, the main control section 120 performs an arithmetic processing of performing printing such as an image development processing, a color conversion processing, an ink color separation processing, and a halftone processing on the basis of the image data, so as to generate nozzle selection data (drive signal selection data) for defining which nozzle of the print head 140 the ink is ejected from, or the amount of ink to be ejected, and to output control signals to respective drivers 114 and 116 on the basis of the drive signal selection data. In addition, since the content of each processing of performing printing that is performed by the main control section 120 is a matter well known in the art of a printing apparatus, the description thereof is omitted here. The respective drivers 114 and 116 output signals for controlling the operation of the paper feed motor 172 and the operation of print head 140, respectively. For example, the head driver 116 supplies the print head 140 with a reference clock signal SCK, a latch signal LAT, a drive signal selection signal SI&SP, and a channel signal CH, which will be described later.

Ink of one or a plurality of colors is supplied to the print head 140 from an ink container, not shown. The print head 140 includes a head interface (IF) 142, a head-side drive circuit 90, a switching controller 160, and an ejection section 150. The ejection section 150 includes a plurality of nozzles which eject the supplied ink and a nozzle actuator 156 (see FIG. 3) corresponding to each nozzle. A piezoelectric element, which is a capacitive load, is used as the nozzle actuator 156 in the exemplary embodiment. The head-side drive circuit 90 and the switching controller 160 operate on the basis of various signals which are input from the control unit 110 through the head interface 142. If the nozzle actuator 156 is driven by a drive signal which will be described later, a vibration plate in a cavity (pressure chamber) communicating with the nozzle is displaced, and a pressure change occurs in the cavity. Therefore, the ink is ejected from the corresponding nozzle due to the pressure change. It is possible to adjust the ejection amount (that is, size of a dot to be formed) of the ink by adjusting the wave height and the slope of voltage increase and decrease of the drive signal used to drive the nozzle actuator 156.

Figure 2:
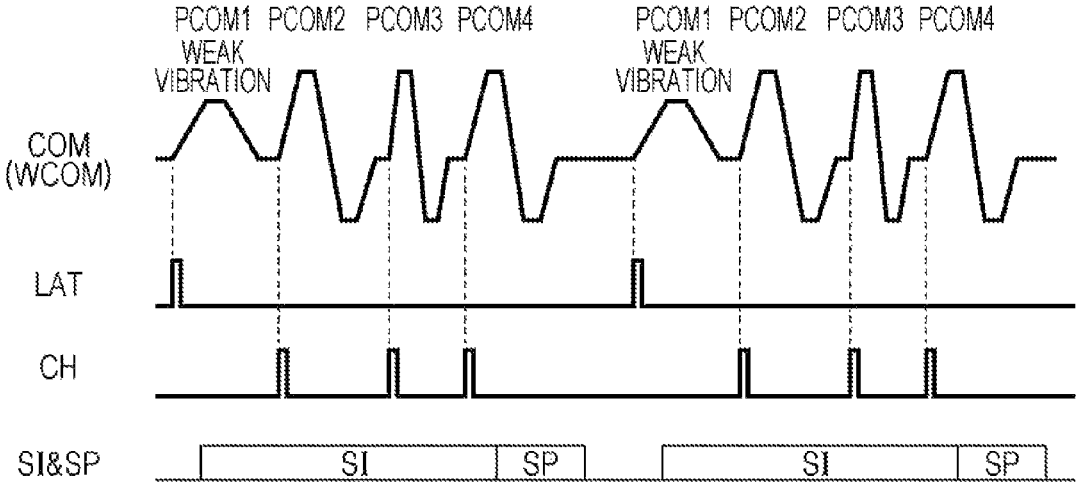
FIG. 2 is an explanatory diagram illustrating an example of various signals used in the print head.

FIG. 2 is an explanatory diagram illustrating an example of various signals used in the print head 140. The drive signal COM is a signal for driving the nozzle actuator 156 provided in the ejection section 150 of the print head 140. The drive signal COM is a minimum unit (unit drive signal) of the drive signal for driving the nozzle actuator 156. The drive signal COM is a signal in which drive pulses PCOMs (drive pulses PCOM1 to PCOM4) are continuous in time series. A set of four drive pulses PCOMs, which are drive pulses PCOM1, PCOM2, PCOM3 and PCOM4, correspond to a pixel (print pixel).

A rising portion of each drive pulse PCOM is a portion for drawing the ink by expanding the volume of the cavity communicating with the nozzle, whereas a falling portion of the drive pulse PCOM is a portion for pushing the ink by reducing the volume of the cavity. Therefore, the ink is ejected from the nozzle by driving the nozzle actuator 156 in accordance with a drive pulse PCOM. One or a plurality of drive pulses PCOM are selected among drive pulse PCOM2, PCOM3 and PCOM4 and supplied to the nozzle actuator 156, so that it is possible to form ink dots of various sizes. In addition, in the exemplary embodiment, a drive pulse PCOM1 called weak vibration is included in the drive signal COM. The drive pulse PCOM1 is used in a case where the ink is drawn in but is not pushed out, for example, in a case where the thickening of the nozzle is suppressed.

The drive signal selection signal SI&SP is a signal to select a nozzle for ejecting the ink and to determine timing at which the nozzle actuator 156 is connected to the drive signal COM. The latch signal LAT and the channel signal CH are signals to connect the drive signal COM to the nozzle actuator 156 of the print head 140, on the basis of the drive signal selection signal SI&SP, after nozzle selection data for all nozzles is input. As illustrated in FIG. 2, the latch signal LAT and the channel signal CH are signals which are synchronous with the drive signal COM. In other words, the latch signal LAT is a signal which becomes a high level in accordance with the start timing of the drive signal COM, and the channel signal CH is a signal which becomes a high level in accordance with the start timing of each drive pulse PCOM constituting the drive signal COM. The outputs of a series of drive signals COM are started in response to the latch signal LAT, and each drive pulse PCOM is output in response to the channel signal CH. Further, a reference clock signal SCK is a signal for transferring the drive signal selection signal SI&SP as a serial signal to the print head 140. In other words, the reference clock signal SCK is a signal used to determine timing at which ink is ejected from the nozzle of the print head 140.

Figure 3:
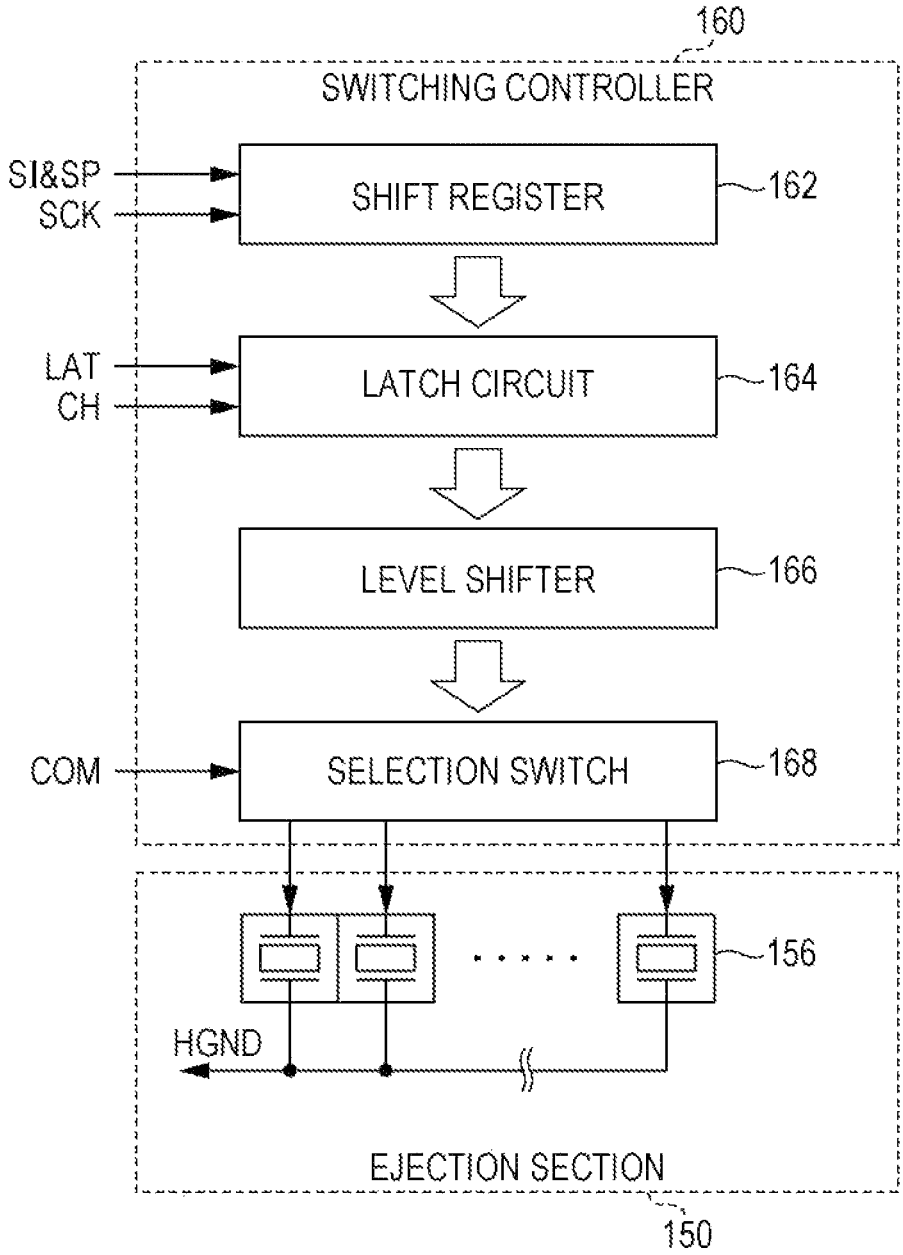
FIG. 3 is an explanatory diagram illustrating a configuration of a switching controller of the print head.

FIG. 3 is an explanatory diagram illustrating a configuration of a switching controller 160 (see FIG. 1) of the print head 140. The switching controller 160 selectively supplies the drive signal COM (drive pulses PCOM) to the nozzle actuator 156. The switching controller 160 includes a shift register 162 that saves the drive signal selection signal SI&SP, a latch circuit 164 that temporarily saves data of the shift register 162, a level shifter 166 that level-converts the output of the latch circuit 164 and supplies the changed output to the selection switch 168, and a selection switch 168 that connects the drive signal COM to the nozzle actuator 156.

The drive signal selection signal SI&SP is sequentially input to the shift register 162, and thus a region, to which data is stored, is sequentially shifted to the subsequent stage in response to the input pulse of the reference clock signal SCK. After the drive signal selection signals SI&SP of the number of nozzles are stored in the shift register 162, the latch circuit 164 latches each output signal of the shift register 162 in response to the latch signal LAT to be input. The signal saved in the latch circuit 164 is converted to a voltage level, at which the selection switch 168 of the subsequent stage can be switched (ON/OFF), by the level shifter 166. The nozzle actuator 156 corresponding to the selection switch 168 to be closed (becomes a connection state) by the output signal of the level shifter 166 is connected to the drive signal COM (drive pulses PCOM) at the connection timing of the drive signal selection signal SI&SP. Thus, the nozzle actuator 156 is changed, and the ink of the amount in response to the drive signal COM is ejected from the nozzle. Further, after the drive signal selection signal SI&SP which is input to the shift register 162 is latched to the latch circuit 164, a subsequent drive signal selection signal SI&SP is input to the shift register 162 and data saved in the latch circuit 164 is sequentially updated in accordance with the ejection timing of the ink. According to the selection switch 168, even after the nozzle actuator 156 is separated from the drive signal COM (drive pulse PCOM), an input voltage of the nozzle actuator 156 is maintained at the voltage immediately before the separation. In addition, a symbol HGND in FIG. 3 denotes a ground end of the nozzle actuator 156.

Figure 4:
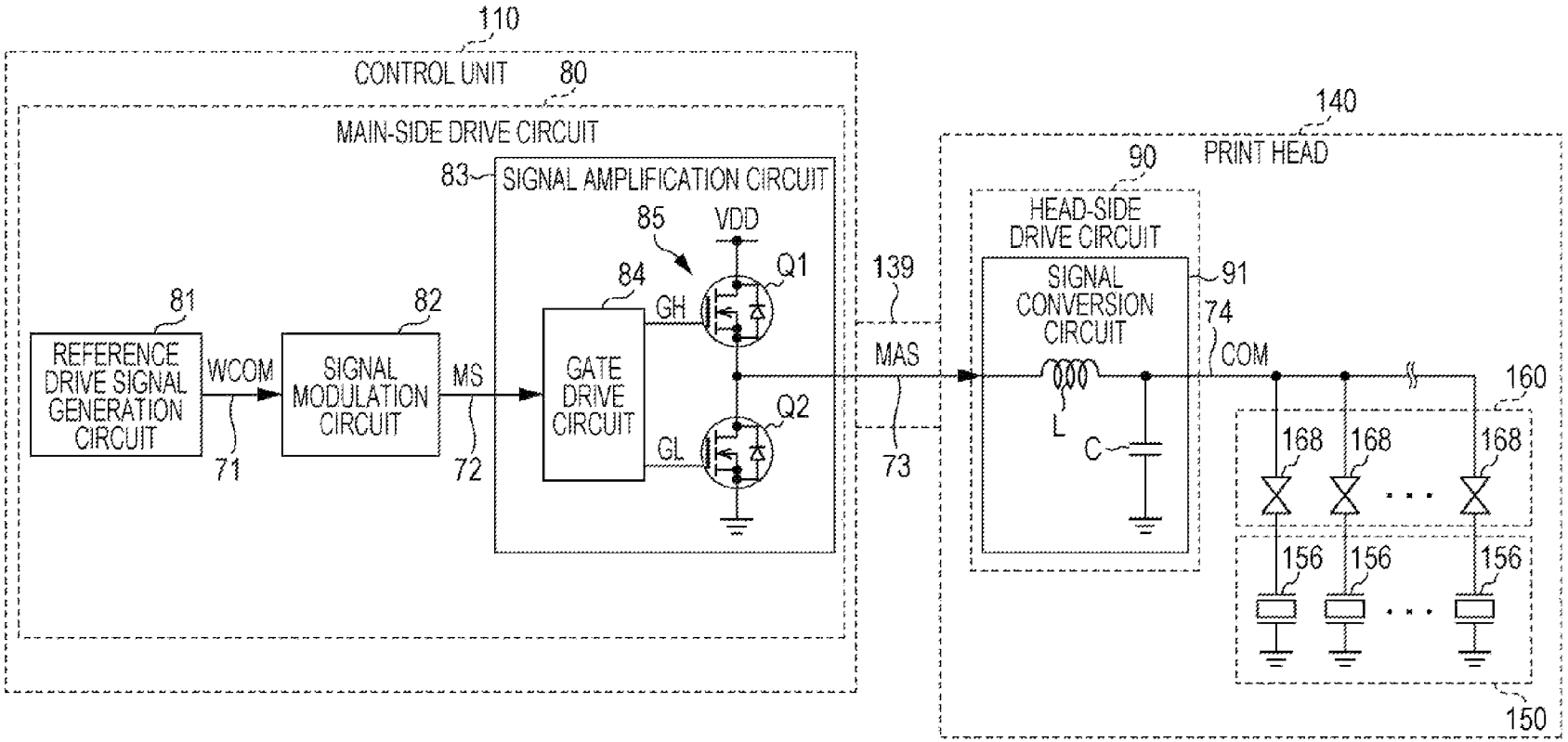
FIG. 4 is an explanatory diagram illustrating a configuration for generating a drive signal COM in the printing apparatus.

FIG. 4 is an explanatory diagram illustrating a configuration for generating a drive signal COM in the printing apparatus 100. In FIG. 4, with respect to the configurations which are not directly related to the generation of the drive signal COM out of the configurations of the printing apparatus 100, the illustration thereof are appropriately omitted. In the exemplary embodiment, the drive signal COM is generated by the main-side drive circuit 80 of the control unit 110 and the head-side drive circuit 90 of the print head 140. The main-side drive circuit 80 includes a reference drive signal generation circuit 81, a signal modulation circuit 82, and a signal amplification circuit 83. Further, the head-side drive circuit 90 includes a signal conversion circuit 91.

The reference drive signal generation circuit 81 is a circuit which generates an analog reference drive signal WCOM which is a reference of the aforementioned drive signal COM. For example, as described in JP-A-2011-207234, the reference drive signal generation circuit 81 is configured to include a waveform memory for storing waveform forming data, which is input from the main control section 120, in a storage element corresponding to a predetermined address, a first latch circuit which latches the waveform forming data read from the waveform memory by a first clock signal, an adder which adds an output of the first latch circuit and waveform forming data W to be output from a second latch circuit that will be described later, a second latch circuit which latches an addition output of the adder by a second clock signal, and a D/A converter which converts the waveform forming data to be output from the second latch circuit to the reference drive signal WCOM that is an analog signal.

The signal modulation circuit 82 is a circuit which receives reference drive signal WCOM from the reference drive signal generation circuit 81 through a reference drive signal transfer line 71 which connects the reference drive signal generation circuit 81 and the signal modulation circuit 82, and generates a modulation reference drive signal MS which is a digital signal by performing a pulse modulation on the reference drive signal WCOM. The exemplary embodiment uses a pulse width modulation (PWM) as a modulation method in the signal modulation circuit 82. In other words, the signal modulation circuit 82 includes a triangular wave oscillator that outputs a triangular wave, and a comparator that compares a reference drive signal WCOM with a triangular wave. The signal modulation circuit 82 generates a modulation reference drive signal MS which is Hi when the reference drive signal WCOM is the triangular wave or more, and is Lo when the reference drive signal WCOM is less than the triangular wave. In addition, although the exemplary embodiment uses a pulse width modulation as a modulation method in the signal modulation circuit 82, but instead thereof, may use other modulation methods (for example, an externally excited or self-excited pulse density modulation (PDM), or a pulse amplitude modulation (PAM)).

The signal amplification circuit 83 is a circuit (a so called D-class amplifier) which receives a modulation reference drive signal MS from the signal modulation circuit 82 through a modulation reference drive signal transfer line 72 for connecting the signal modulation circuit 82 and a signal amplification circuit 83, and generates a modulation drive signal MAS by performing power amplification on the modulation reference drive signal MS. The signal amplification circuit 83 includes a half-bridge output stage 85 configured by two switching elements (a high-side switching element Q1 and a low-side switching element Q2) for substantially amplifying the power, and a gate drive circuit 84 which adjusts respective gate-source signals GH and GL of the switching elements Q1 and Q2, on the basis of the modulation reference drive signal MS from the signal modulation circuit 82. In the signal amplification circuit 83, when the modulation reference drive signal MS is high level, the gate-source signal GH becomes high level and thus the high-side switching element Q1 turns ON, but the gate-source signal GL becomes low level and thus the low-side switching element Q2 turns OFF. As a result, the output of the half-bridge output stage 85 is a supply voltage VDD. On the other hand, when the modulation reference drive signal MS is low level, the gate-source signal GH becomes low level, and thus high-side switching element Q1 turns OFF, but the gate-source signal GL becomes high level and thus the low-side switching element Q2 turns ON. As a result, the output of the half-bridge output stage 85 becomes zero. In this way, the signal amplification circuit 83 performs power amplification by switching operations of the high-side switching element Q1 and the low-side switching element Q2 on the basis of the modulation reference drive signal MS, and thus the modulation drive signal MAS is generated.

The signal conversion circuit 91 is a circuit (a so-called smoothing filter) which receives the modulation drive signal MAS from the signal amplification circuit 83 through the modulation drive signal transfer line 73 for connecting the signal amplification circuit 83 and the signal conversion circuit 91, and generates the drive signal COM (drive pulse PCOM) which is an analog signal by smoothing the modulation drive signal MAS. In addition, a part of the modulation drive signal transfer line 73 is disposed on a flexible flat cable 139 for connecting a control unit 110 and a print head 140. In the exemplary embodiment, a low pass filter using a combination of a capacitor C and a coil L is used as the signal conversion circuit 91. The signal conversion circuit 91 attenuates modulation frequency components generated in the signal modulation circuit 82, and outputs the drive signal COM (drive pulses PCOM) having a waveform characteristic described above. The drive signal COM generated by the signal conversion circuit 91 is supplied to the nozzle actuator 156 of the ejection section 150 through the drive signal transfer line 74 for connecting the signal conversion circuit 91 and the nozzle actuator 156.

Here, in the exemplary embodiment, each signal transfer line is configured such that the sum of a resistance value of the reference drive signal transfer line 71 and a resistance value of the drive signal transfer line 74 is smaller than the sum of a resistance value of the modulation reference drive signal transfer line 72 and a resistance value of the modulation drive signal transfer line 73. Specifically, respective signal transfer lines have substantially the same material and diameter, and the sum of a length of the reference drive signal transfer line 71 and a length of the drive signal transfer line 74 is shorter than the sum of a length of the modulation reference drive signal transfer line 72 and a length of the modulation drive signal transfer line 73. In addition, since the drive signal transfer line 74 is a signal line that connects the signal conversion circuit 91 and each nozzle actuator 156 in the ejection section 150, it is assumed that the length of the drive signal transfer line 74 is an average of lengths of respective drive signal transfer lines 74 that connect the signal conversion circuit 91 and each nozzle actuator 156 in the ejection section 150. Further, in the present specification, a resistance value of a signal line means total conductor resistance of signal lines (electrical resistance between one end and other end of the signal line).

The reference drive signal transfer line 71 and the drive signal transfer line 74 are signal lines for transferring an analog signal which is relatively likely to receive an influence of noise, whereas the modulation reference drive signal transfer line 72 and the modulation drive signal transfer line 73 are signal lines for transferring a digital signal which is relatively unlikely to receive an influence of noise. In the exemplary embodiment, since the sum of the resistance values of the signal lines (reference drive signal transfer line 71 and the drive signal transfer line 74) for transferring an analog signal is smaller than the sum of the resistance values of the signal lines (the modulation reference drive signal transfer line 72 and the modulation drive signal transfer line 73) for transferring a digital signal, in a process from when the reference drive signal WCOM is output by the reference drive signal generation circuit 81 to when the drive signal COM is input to the nozzle actuator 156, it is possible to suppress the influence of noise on the signal, thereby improving the ejection stability of the ink by suppressing noise components in the drive signal COM.

Further, in the exemplary embodiment, the drive signal transfer line 74 has the smallest resistance value among four signal transfer lines. Specifically, the drive signal transfer line 74 has the shortest length among four signal transfer lines. Since the drive signal transfer line 74 is closest to the nozzle actuator 156 in the ejection section 150, among four signal transfer lines, the noise superimposed to a transmission signal (the drive signal COM) in the drive signal transfer line 74 has a relatively large influence on the ejection stability degradation of the ink. Further, the noise can be reduced by the filter located immediately before the nozzle actuator 156 of the ejection section 150, but this may result in distortion in the drive signal COM to be supplied to the nozzle actuator 156. Since the drive signal transfer line 74 has the smallest resistance value among four signal transfer lines in the exemplary embodiment, it is possible to suppress as much noise in the drive signal transfer line 74 which has a great influence on the ejection stability degradation of the ink and to effectively improve the ejection stability of the ink, while suppressing the distortion of the drive signal COM.

Further, in the exemplary embodiment, the resistance value of the modulation reference drive signal transfer line 72 is smaller than the resistance value of the modulation drive signal transfer line 73. Specifically, the length of the modulation reference drive signal transfer line 72 is shorter than the length of the modulation drive signal transfer line 73. The modulation reference drive signal transfer line 72 is a signal line for transferring a signal (modulation reference drive signal MS) before signal amplification is performed by the signal amplification circuit 83. Therefore, if noise is superimposed on the signal (modulation reference drive signal MS) to be transferred by the modulation reference drive signal transfer line 72, the noise components in the signal amplification circuit 83 is amplified and the influence on the ejection stability degradation of the ink caused by the noise components is increased. Since the resistance value of the modulation reference drive signal transfer line 72 is smaller than the resistance value of the modulation drive signal transfer line 73 in the exemplary embodiment, it is possible to suppress as much noise superimposed on the signal before amplification, and to effectively improve the ejection stability of the ink.

Further, the resistance value of the drive signal transfer line 74 is smaller than the resistance value of the modulation drive signal transfer line 73 in the exemplary embodiment. Specifically, the length of the drive signal transfer line 74 is shorter than the length of the modulation drive signal transfer line 73. Both the modulation drive signal transfer line 73 and the drive signal transfer line 74 are signal lines for transferring a signal after signal amplification by the signal amplification circuit 83, but the modulation drive signal transfer line 73 is a signal line for transferring an analog signal (modulation drive signal MAS), whereas the drive signal transfer line 74 is a signal line for transferring a digital signal (the drive signal COM). Generally, since an attenuation rate of a digital signal is smaller than that of an analog signal, noise components to be superimposed on the drive signal transfer line 74 for transferring a digital signal is likely to remain. Since the resistance value of the drive signal transfer line 74 is smaller than the resistance value of the modulation drive signal transfer line 73 in the exemplary embodiment, it is possible to suppress as much residual noise and to effectively improve the ejection stability of the ink.

Further, in the exemplary embodiment, in a configuration in which the print head 140 of a serial printer is operated by disposing the signal amplification circuit 83 on the control unit 110 side, and disposing the signal conversion circuit 91 on the print head 140 side, the modulation drive signal MAS in which noise is most unlikely to be put is transferred to between the control unit 110 and the print head 140 in which great amount of noise is likely to be put, so that it is possible to suppress as much residual noise and to effectively improve the ejection stability of the ink. Effect of such a configuration appears particularly large in a large format serial printer which performs a printing on A3 or more in which a distance between the print head 140 and the control unit 110 is likely to be long.

B. MODIFICATION EXAMPLES

In addition, the invention is not limited to the exemplary embodiment, the invention can be implemented in various embodiments without departing from the scope and spirit thereof, and for example, the following modifications are also possible.

B1. Modification Example 1

Figure 5:
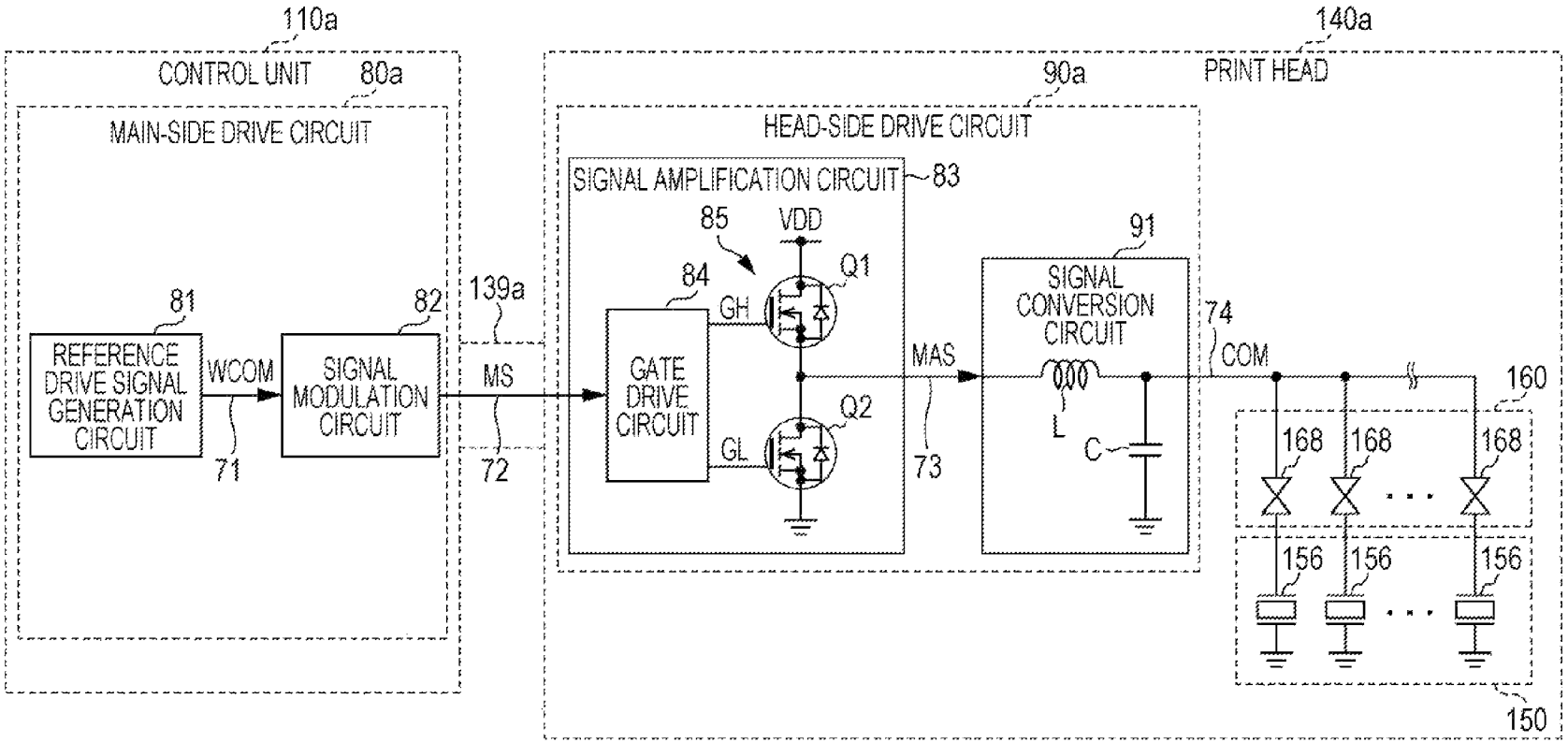
FIG. 5 is an explanatory diagram illustrating a configuration for generating the drive signal COM in a modification example.

The configuration of the printing apparatus 100 in the exemplary embodiment is merely an example, and various modifications are possible. FIG. 5 is an explanatory diagram illustrating a configuration for generating a drive signal COM in a modification example. The modification example illustrated in FIG. 5 is different from the exemplary embodiment illustrated in FIG. 4 in that the signal amplification circuit 83 is not disposed in the main-side drive circuit 80*a* of the control unit 110*a*, but is disposed inside the head-side drive circuit 90*a* of the print head 140*a*. As similar to the exemplary embodiment illustrated in FIG. 4, even the modification example illustrated in FIG. 5 is configured such that the sum of the resistance value of the reference drive signal transfer line 71 and the resistance value of the drive signal transfer line 74 is smaller than the sum of the resistance value of the modulation reference drive signal transfer line 72 and the resistance value of the modulation drive signal transfer line 73, so that in a process from when the reference drive signal WCOM is output by the reference drive signal generation circuit 81 to when the drive signal COM is input to the nozzle actuator 156, it is possible to suppress the influence of noise on the signal, and to improve the ejection stability of the ink. Further, since the drive signal transfer line 74 has the smallest resistance value among four signal transfer lines in the modification example illustrated in FIG. 5, it is possible to suppress as much noise in the drive signal transfer line 74 which has a great influence on the ejection stability degradation of the ink, and to effectively improve the ejection stability of the ink, while suppressing the distortion of the drive signal COM. Further, since the resistance value of the modulation reference drive signal transfer line 72 is smaller than the resistance value of the modulation drive signal transfer line 73 in the modification example illustrated in FIG. 5, it is possible to suppress as much noise superimposed on the signal before amplification, and to effectively improve the ejection stability of the ink. Further, since the resistance value of the drive signal transfer line 74 is smaller than the resistance value of the modulation drive signal transfer line 73 in the modification example illustrated in FIG. 5, it is possible to suppress as much residual noise, and to effectively improve the ejection stability of the ink.

Figure 6:
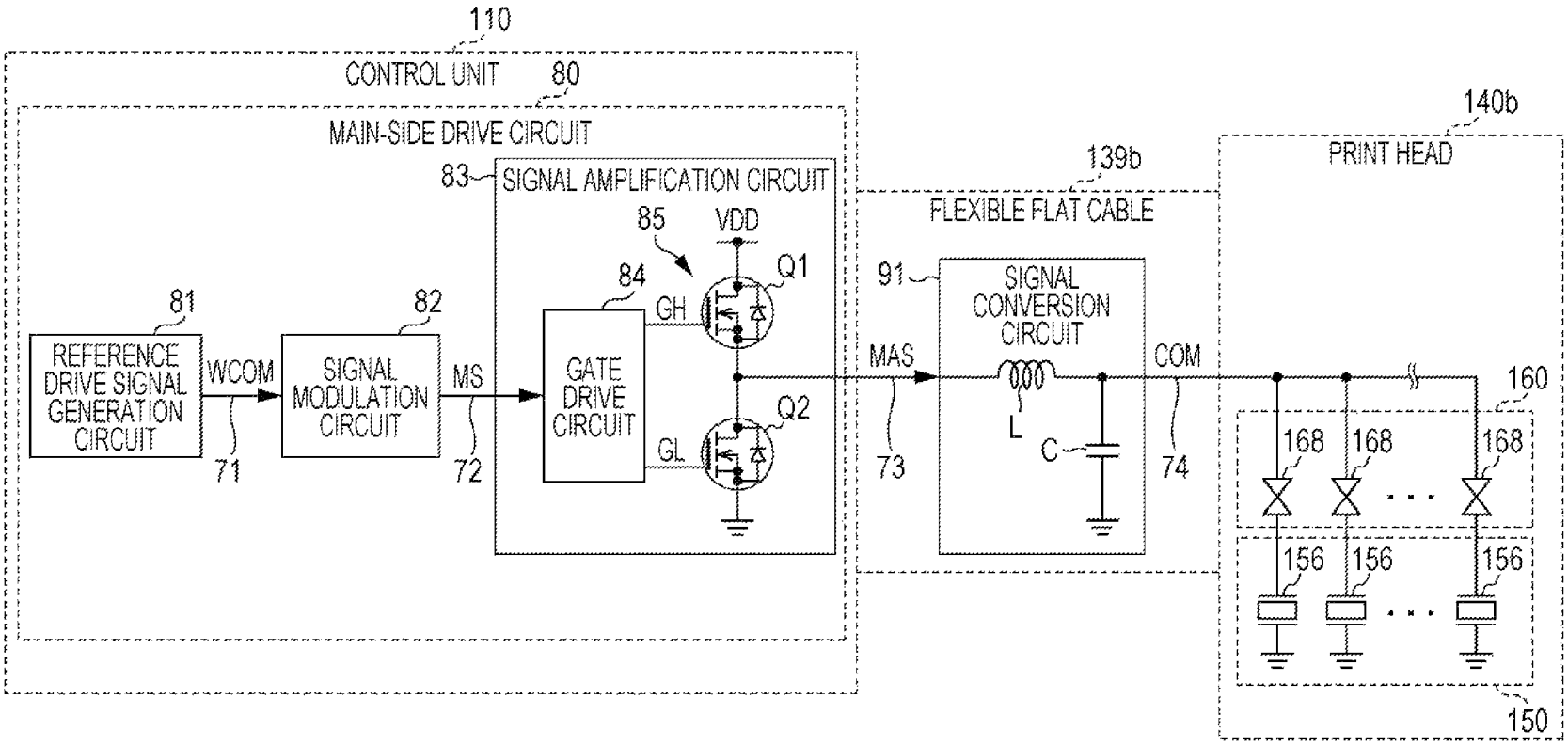
FIG. 6 is an explanatory diagram illustrating a configuration for generating the drive signal COM in another modification example.

FIG. 6 is an explanatory diagram illustrating a configuration for generating a drive signal COM in another modification example. The modification example illustrated in FIG. 6 is different from the exemplary embodiment illustrated in FIG. 4 in that the signal conversion circuit 91 is not disposed in the head-side drive circuit 90 of a print head 140*b*, but is disposed on a flexible flat cable 139*b* which connects the control unit 110 and a print head 140*b*. As similar to the exemplary embodiment illustrated in FIG. 4, even the modification example illustrated in FIG. 6 is configured such that the sum of the resistance value of the reference drive signal transfer line 71 and the resistance value of the drive signal transfer line 74 is smaller than the sum of the resistance value of the modulation reference drive signal transfer line 72 and the resistance value of the modulation drive signal transfer line 73, so that in a process from when the reference drive signal WCOM is output by the reference drive signal generation circuit 81 to when the drive signal COM is input to the nozzle actuator 156, it is possible to suppress the influence of noise on the signal, and to improve the ejection stability of the ink. Further, since the drive signal transfer line 74 has the smallest resistance value among four signal transfer lines in the modification example illustrated in FIG. 6, it is possible to suppress as much noise in the drive signal transfer line 74 which has a great influence on the ejection stability degradation of the ink, and to effectively improve the ejection stability of the ink, while suppressing the distortion of the drive signal COM. Further, since the resistance value of the modulation reference drive signal transfer line 72 is smaller than the resistance value of the modulation drive signal transfer line 73 in the modification example illustrated in FIG. 6, it is possible to suppress as much noise superimposed on the signal before amplification, and to effectively improve the ejection stability of the ink. Further, since the resistance value of the drive signal transfer line 74 is smaller than the resistance value of the modulation drive signal transfer line 73 in the modification example illustrated in FIG. 6, it is possible to suppress as much residual noise, and to effectively improve the ejection stability of the ink.

Further, although a piezoelectric element is employed as the nozzle actuator 156 in the exemplary embodiment, another configuration may be employed if it is an actuator which drives a nozzle so as to eject a liquid. Further, although a low pass filter using a combination of a capacitor C and a coil L is used as the signal conversion circuit 91 in the exemplary embodiment, if it is a circuit which generates the analog drive signal COM from the digital modulation drive signal MAS, a circuit of any configuration may be employed. Although the printing apparatus 100 receives image data from the host computer 200 to perform a printing process in the exemplary embodiment, instead thereof, the printing apparatus 100 may perform the printing process on the basis of, for example, image data acquired from a memory card, image data acquired from a digital camera through a predetermined interface, image data acquired by a scanner, and the like. Further, the main control section 120 of the printing apparatus 100 which receives image data performs an arithmetic processing of performing printing such as an image development processing, a color conversion processing, an ink color separation processing, and a halftone processing in the exemplary embodiment, the arithmetic processing may be performed by the host computer 200. In this case, the printing apparatus 100 receives a print command generated using the arithmetic processing by the host computer 200, and performs a print processing according to the print command. Even in this case, the printing apparatus 100 can perform the same print process as that in the aforementioned exemplary embodiment. Further, the invention is applicable to a serial printer in which a carriage for mounting the print head 140 is reciprocated during printing, and is also applicable to a line printer without being accompanied by such reciprocation. Further, the invention is also applicable to an on-carriage type printer in which an ink cartridge is reciprocated along with a carriage, and is also applicable to an off-carriage type printer in which the holder for mounting an ink cartridge is provided in a location other than a carriage, and ink is supplied from the ink cartridge to a print head 140 through a flexible tube or the like. Further, the invention is also applicable to a printing apparatus which forms an image on print media with a liquid other than ink (including the fluid-like material such as a liquid body or a gel in which particles of functional materials are dispersed).

Further, a part of the configuration realized by hardware in the exemplary embodiment may be replaced by software, on the contrary, a part of the configuration realized by software in the exemplary embodiment may be replaced by hardware. Further, in a case where all or a part of functions of the invention is realized by software, the software (computer program) can be provided in a form stored on a computer readable recording medium. In the invention, "computer readable recording medium" is not limited to a portable recording medium such as a flexible disk and a CD-ROM, but includes an internal storage device, installed in a computer, such as various ROMs and RAMs, and an external storage device, fixed to the computer, such as a hard disk, or the like.

B2. Modification Example 2

Although the drive signal transfer line 74 has the smallest resistance value among four signal transfer lines in the exemplary embodiments or the modification examples, instead thereof, the reference drive signal transfer line 71 may have the smallest resistance value among four signal transfer lines. Since the reference drive signal transfer line 71 is a signal line which transfers a signal (reference drive signal WCOM) before signal amplification by the signal amplification circuit 83, if noise is superimposed on a signal (reference drive signal WCOM) transferred by the reference drive signal transfer line 71, noise components are also amplified in the signal amplification circuit 83, and thus influence on the discharge stability degradation of ink due to the noise components is increased. Since the reference drive signal transfer line 71 has the smallest resistance value among four signal transfer lines in the modification examples, it is possible to suppress as much noise superimposed on the signal before amplification, and to effectively improve the ejection stability of the ink.

B3. Modification Example 3

Although the resistance value of the modulation reference drive signal transfer line 72 is smaller than the resistance value of the modulation drive signal transfer line 73 in the exemplary embodiments or the modification examples, on the contrary, the resistance value of the modulation drive signal transfer line 73 may be smaller than the resistance value of the modulation reference drive signal transfer line 72 (the resistance value of the modulation reference drive signal transfer line 72 is greater than the resistance value of the modulation drive signal transfer line 73). In general, if the length of the signal line is long after signal is amplified, the signal is likely to be attenuated. Since the resistance value of the modulation drive signal transfer line 73 which transfers a signal (modulation drive signal MAS) after amplification by the signal amplification circuit 83 is smaller than the resistance value of the modulation reference drive signal transfer line 72 which transfers a signal (modulation reference drive signal MS) before amplification in the modification examples, it is possible to suppress an attenuation of the signal after amplification, and thus to suppress a decrease in ejection stability of the ink.

B4. Modification Example 4

Although it is assumed that the materials and the diameters of all four signal transfer lines are substantially identical to each other in the exemplary embodiments or the modification examples, signal transfer lines in which at least one of the materials and the diameters is different from each other may be included. Even if at least one of the materials and the diameters of four signal transfer lines are not substantially identical to each other, if the resistance value of each signal line, which is determined by a material, a diameter, and a length, satisfies a relationship described in the exemplary embodiments or the modification examples, the same effect as that of the exemplary embodiments or the modification examples is achieved. In addition, if it is assumed that material and diameters of all four signal transfer lines are substantially identical to each other, the magnitude of the resistance value of each signal transfer lines is determined by the length of each signal transfer line, so that it is possible to readily determine the arrangement of each circuit (reference drive signal generation circuit 81, and the like) in order to satisfy the magnitude relationship of the resistance values as described above.

The entire disclosure of Japanese Patent Application No. 2012-224847, filed Oct. 10, 2012 is expressly incorporated by reference herein.

What is claimed is:

1. A liquid ejecting apparatus comprising:

a reference drive signal generation section that generates an analog reference drive signal;

a signal modulation section that modulates the reference drive signal to generate a digital modulation reference drive signal;

a signal amplification section that amplifies the modulation reference drive signal to generate a modulation drive signal;

a signal conversion section that converts the modulation drive signal to an analog drive signal;

a liquid ejecting section that ejects a liquid in response to the drive signal;

a reference drive signal transfer line that transfers the reference drive signal from the reference drive signal generation section to the signal modulation section;

a modulation reference drive signal transfer line that transfers the modulation reference drive signal from the signal modulation section to the signal amplification section;

a modulation drive signal transfer line that transfers the modulation drive signal from the signal amplification section to the signal conversion section; and a drive signal transfer line that transfers the drive signal from the signal conversion section to the liquid ejecting section, wherein a sum of a resistance value of the reference drive signal transfer line and a resistance value of the drive signal transfer line is smaller than a sum of a resistance value of the modulation reference drive signal transfer line and a resistance value of the modulation drive signal transfer line.

2. The liquid ejecting apparatus according to claim 1, wherein the drive signal transfer line has a smallest resistance value among the signal transfer lines.

3. The liquid ejecting apparatus according to claim 1, wherein the reference drive signal transfer line has a smallest resistance value among the signal transfer lines.

4. The liquid ejecting apparatus according to claim 1, wherein a resistance value of the modulation reference drive signal transfer line is smaller than a resistance value of the modulation drive signal transfer line.

5. The liquid ejecting apparatus according to claim 1, wherein a resistance value of the modulation reference drive signal transfer line is greater than a resistance value of the modulation drive signal transfer line.

6. The liquid ejecting apparatus according to claim 1, wherein a resistance value of the drive signal transfer line is smaller than a resistance value of the modulation drive signal transfer line.

7. A liquid ejecting apparatus comprising:

a reference drive signal generation section that generates an analog reference drive signal;

a signal modulation section that modulates the reference drive signal to generate a digital modulation reference drive signal;

a signal amplification section that amplifies the modulation reference drive signal to generate a modulation drive signal;

a signal conversion section that converts the modulation drive signal to an analog drive signal;

a liquid ejecting section that ejects a liquid in response to the drive signal;

a reference drive signal transfer line that transfers the reference drive signal from the reference drive signal generation section to the signal modulation section;

a modulation reference drive signal transfer line that transfers the modulation reference drive signal from the signal modulation section to the signal amplification section;

a modulation drive signal transfer line that transfers the modulation drive signal from the signal amplification section to the signal conversion section; and a drive signal transfer line that transfers the drive signal from the signal conversion section to the liquid ejecting section, wherein a sum of a length of the reference drive signal transfer line and a length of the drive signal transfer line is smaller than a sum of a length of the modulation reference drive signal transfer line and a length of the modulation drive signal transfer line.

8. The liquid ejecting apparatus according to claim 7, wherein the drive signal transfer line has a shortest length among the signal transfer lines.

9. The liquid ejecting apparatus according to claim 7, wherein the reference drive signal transfer line has a shortest length among the signal transfer lines.

10. The liquid ejecting apparatus according to claim 7, wherein a length of the modulation reference drive signal transfer line is shorter than a length of the modulation drive signal transfer line.

11. The liquid ejecting apparatus according to claim 7, wherein a length of the modulation reference drive signal transfer line is longer than a length of the modulation drive signal transfer line.

12. The liquid ejecting apparatus according to claim 7, wherein a length of the drive signal transfer line is shorter than a length of the modulation drive signal transfer line.

* * * * *